US007830096B2

(12) United States Patent
Chen et al.

(10) Patent No.: US 7,830,096 B2
(45) Date of Patent: Nov. 9, 2010

(54) CIRCUIT WITH IMPROVED EFFICIENCY AND CREST FACTOR FOR CURRENT FED BIPOLAR JUNCTION TRANSISTOR (BJT) BASED ELECTRONIC BALLAST

(75) Inventors: Timothy Chen, Aurora, OH (US); Nitin Kumar, Mayfield Heights, OH (US); James K. Skully, Willoughby, OH (US)

(73) Assignee: General Electric Company, Schenectady, NY (US)

( * ) Notice: Subject to any disclaimer, the term of this patent is extended or adjusted under 35 U.S.C. 154(b) by 76 days.

(21) Appl. No.: 11/931,860

(22) Filed: Oct. 31, 2007

(65) Prior Publication Data

US 2009/0108766 A1 Apr. 30, 2009

(51) Int. Cl.
*H05B 39/04* (2006.01)

(52) U.S. Cl. ..... 315/224; 315/209 R; 315/226

(58) Field of Classification Search ..... 315/98, 315/226, 307, 209 R, 224
See application file for complete search history.

(56) References Cited

U.S. PATENT DOCUMENTS

| | | | | |
|---|---|---|---|---|
| 4,525,648 | A | 6/1985 | De Bijl et al. | |
| 4,682,082 | A | 7/1987 | MacAskill et al. | |
| 5,124,619 | A * | 6/1992 | Moisin et al. | 315/219 |
| 5,424,615 | A | 6/1995 | Kang | |
| 5,438,243 | A * | 8/1995 | Kong | 315/219 |
| 6,465,972 | B1 | 10/2002 | Kachmarik et al. | |
| 7,099,132 | B2 * | 8/2006 | Moisin | 361/91.1 |
| 7,193,368 | B2 | 3/2007 | Chen et al. | |
| 2006/0050542 | A1 | 3/2006 | Chan et al. | |
| 2006/0103317 | A1 * | 5/2006 | Chen et al. | 315/98 |
| 2006/0103328 | A1 | 5/2006 | Chen et al. | |
| 2007/0025123 | A1 * | 2/2007 | Kim et al. | 363/16 |

FOREIGN PATENT DOCUMENTS

WO WO2006/051459 5/2006

OTHER PUBLICATIONS

PCT/US2008/076024 International Search Report, mailed Nov. 18, 2008.
U.S. Appl. No. 11/645,939, filed Dec. 27, 2006, Chen et al.

* cited by examiner

*Primary Examiner*—Douglas W Owens
*Assistant Examiner*—Jianzi Chen
(74) *Attorney, Agent, or Firm*—Fay Sharpe LLP

(57) ABSTRACT

A current fed bipolar junction transistor (BJT) based inverter ballast includes base drive circuits configured to drive respective BJT switches, and high-speed drive reverse peak current limiting circuits, configured to operate in conjunction with the respective base drive circuits.

14 Claims, 3 Drawing Sheets

CIRCUIT WITH IMPROVED EFFICIENCY AND CREST FACTOR FOR CURRENT FED BIPOLAR JUNCTION TRANSISTOR (BJT) BASED ELECTRONIC BALLAST

BACKGROUND OF THE INVENTION

The present application is directed to lighting devices, and more particularly to ballast circuitry for discharge lamps. Current fed bipolar junction transistor (BJT) based inverter ballasts are widely used in the lamp-lighting industry due to their inherent parallel lamp operation and output transformer isolation features. Providing transformer isolation permits parallel lamp operation and re-lamping of the lighting system to take place without requiring the shutdown of the power inverter of the entire system. Therefore, a lamp failure in the system can be replaced when it is needed while the remaining lamps are maintained in an "on" state. This therefore also reduces the maintenance and operational costs of such systems.

An example of a current fed inverter ballast having an instant program start configuration for use with parallel lamps has been described in U.S. Pat. No. 7,193,368, titled Parallel Lamps With Instant Program start Electronic Ballast, to Chen et al., issued Mar. 20, 2007. This ballast takes advantage of the beneficial aspects of a program start ballast (e.g., longer lamp life) and combines it with the advantages of an instant start ballast (e.g., quick start time) to produce an improved lamp ballast wherein parallel lamps are driven. Another circuit of this type is set forth in U.S. application Ser. No. 11/645,939, titled Switching Control For Inverter Startup And Shutdown, to Chen et al. filed Dec. 27, 2006, which describes a current fed BJT based inverter including a low cost shutdown circuit. Both U.S. Pat. No. 7,193,368 to Chen et al., and U.S. application Ser. No. 11/645,939 to Chen et al. are both hereby incorporated by reference in their entireties.

A drawback of existing current fed BJT based ballast systems which provide output transformer isolation is that they tend to have an efficiency which is relatively low compared to non-isolated lamp lighting ballasts due to the isolation transformer and operation mode of the BJTs. Therefore, a particular issue with such BJT based electronic ballasts has to do with the optimization of their base drive to improve the operational efficiency of these devices. Attempts to optimize the base drive signals commonly results in overdriving of the base-to-emitter junction of the BJT switches. This is a particular issue where the base of the BJT is driven by a parallel diode-resistor arrangement. In such configurations, when the base-to-emitter junction is overdriven, an undesirable increase in power dissipation takes place in the BJTs, and a higher circulating current exists in the ballast resulting in lower ballast efficiency. Another drawback which occurs due to overdriving is that dead-time, i.e., the overlap between the two transistor switching times, increases, leading to a higher current crest factor. Where current crest factor is the peak current divided by the root-mean-square (rms) current of lamp. ANSI standards require current crest factor to be less than 1.7.

Further, when current fed BJTs are used in conjunction with high efficiency lamp striations are known to occur even at room temperature. Striations manifest themselves as dark bands along the length of lamps and are particularly prevalent in lamps which use a high percentage of Krypton (Kr), which is employed as a buffer gas to improve the efficacy and usefulness of the lamps. For example, high efficiency lamps, may have a content of approximately 40 percent to 70 percent of Krypton (Kr).

Concepts of the present application are intended to address these and other outstanding issues as they relate to current fed BJT based inverter ballasts.

Prior art which may be of interest to the above-identified issues and others include U.S. Pat. No. 4,682,082, titled Gas Discharge Lamp Energization Circuit, to MacAskill et al., issued on Jul. 21, 1987; U.S. Patent Application Publication No. US2006/0103328, titled Striation Control For Current Fed Electronic Ballast, to Chen et al., published on May 18, 2006; U.S. Pat. No. 6,465,972, titled Electronic Elimination of Striations In Linear Lamps, to Kachmarik et al., issued on Oct. 15, 2002; and WO2006/051459, titled ANTI-STRIATION CIRCUIT FOR A GAS DISCHARGE LAMP BALLAST, to Fang, published May 18, 2006.

BRIEF DESCRIPTION OF THE INVENTION

A current fed bipolar junction transistor (BJT) based inverter ballast includes base drive circuits configured to drive respective BJT switches, and high-speed drive reverse peak current limiting circuits, configured to operate in conjunction with the respective base drive circuits.

DETAILED DESCRIPTION OF THE INVENTION

Figure 1:
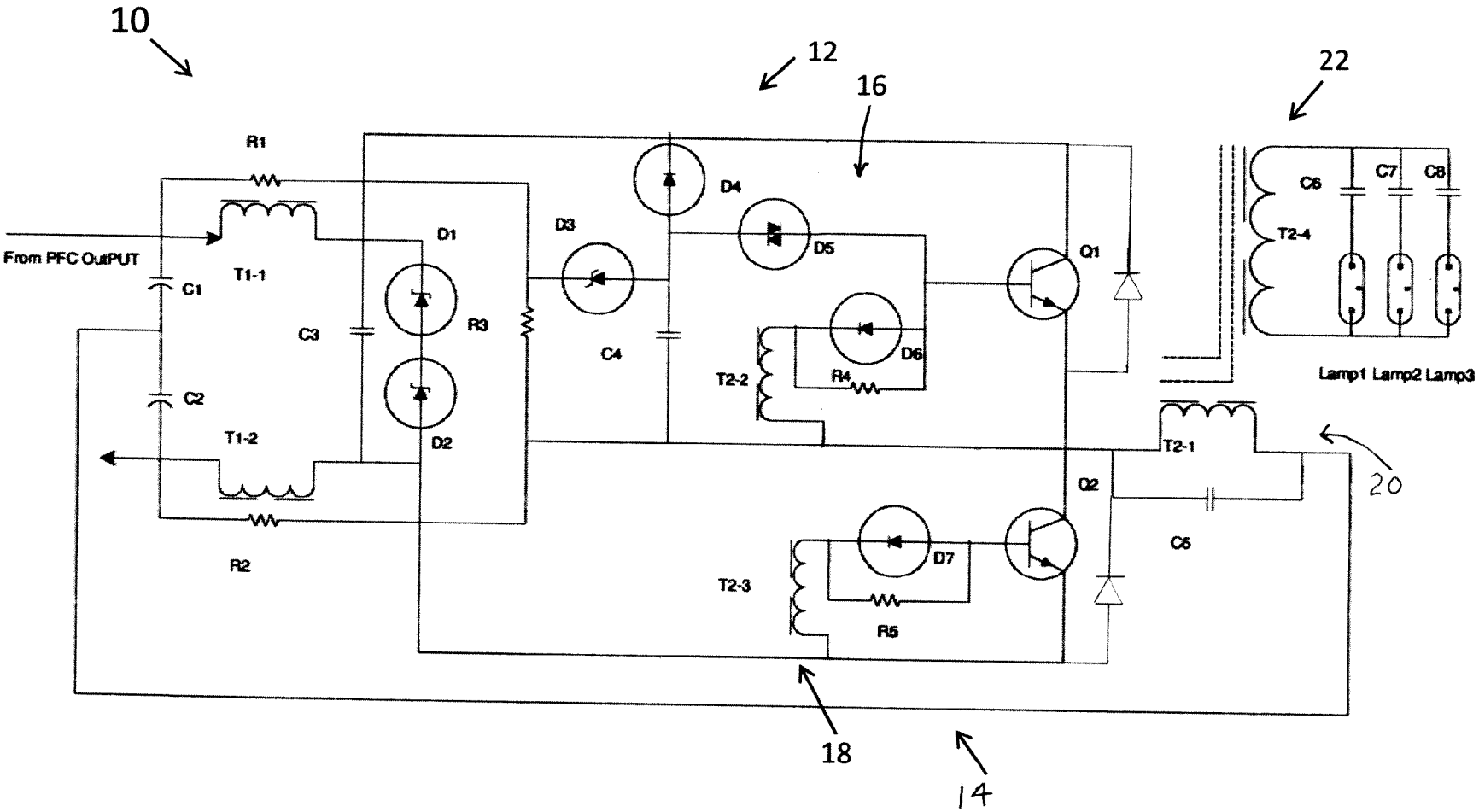
FIGURE 1 PRIOR ART
FIG. 1 illustrates an existing electronic ballast type configuration in which the concepts of the present application may be used.

Turning to FIG. 1, illustrated is a particular circuit in which the concepts of the present application may be employed. It is to be appreciated, however, the concepts described herein are not intended to be limited only to such a circuit, and may be employed in other lamp lighting control circuits. That having been said, FIG. 1 is a half-bridge current fed ballast 10 which includes a first or upper switching configuration 12, and a second or lower switching configuration 14. These switching configurations include BJT switches Q1 and Q2, respectively. BJT switch Q1 is driven by a first or upper BJT control or base drive circuit 16, and BJT switch Q2 is driven by second or lower BJT control or base drive circuit 18. First or upper BJT control circuit includes zener diode D3, capacitor C4, diode D4, diode D5, diode D6, resistor R4, and transformer winding T2-2. Second or lower BJT control circuit 18 is comprised of diode D7, resistor R5 and transformer winding T2-3.

An output transformer system 20, including capacitor C5 and output winding T2-1, provides output signals to lamp network 22, which includes lamp connector winding T2-4, and lamp capacitors C6, C7 and C8. Additionally, circuitry such as power zener diodes D1 and D2 and voltage input network including resistors R1, R2 and R3, capacitor network C1, C2 and C3 and windings T1-1 and T1-2 are further incorporated in the circuit, to provide a pulsed DC current signal to the BJT control or base drive control circuits 16, 18, which in turn selectively supplies a drive signal to the BJT switches Q1, Q2.

For a more detailed discussion regarding operation of a comparable circuit, reference may be made to commonly assigned U.S. Pat. No. 6,989,637, titled Voltage Controlled Start-Up Circuit for Electronic Ballast, to Chen et al., issued Jan. 24, 2006, hereby incorporated by reference in its entirety.

An issue with circuit 10 of FIG. 1, and similar circuit designs, is that overdriving of BJT switches Q1 and Q2, causes increased power dissipation on Q1, Q2 and increased circulating current within the circuit, resulting in lowering the efficiency of the inverter. Also an increase in dead time switching occurs leading to an increased crest factor of the lamp current. On the other hand, underdriving of the BJT switches will result in excessive temperatures on the BJTs (such as measured in the high temperature ALT tests), resulting in potential failure of the ballast.

The concepts of the present application allow an optimization of the base drive to the BJT switches by provision of a high-speed drive with peak current limiting circuit which is shown and will be described in connection with FIG. 2 as being incorporated into the BJT control or base drive circuits 16, 18. The high-speed drive with peak current limiting circuit acts to not only reduce switching and inverter magnetic losses, but also improve the crest factor by increasing the turn-on/off time of the BJTs.

The newly added changes to the circuit can also be implemented to control the switching speed of BJT switches Q1, Q2 to provide a rich, even harmonic voltage waveform to the lamp or lamps. This even harmonic waveform acts to diminish or eliminate visible striations that may otherwise be found on the lamp or lamps controlled by the new ballast.

Figure 2:
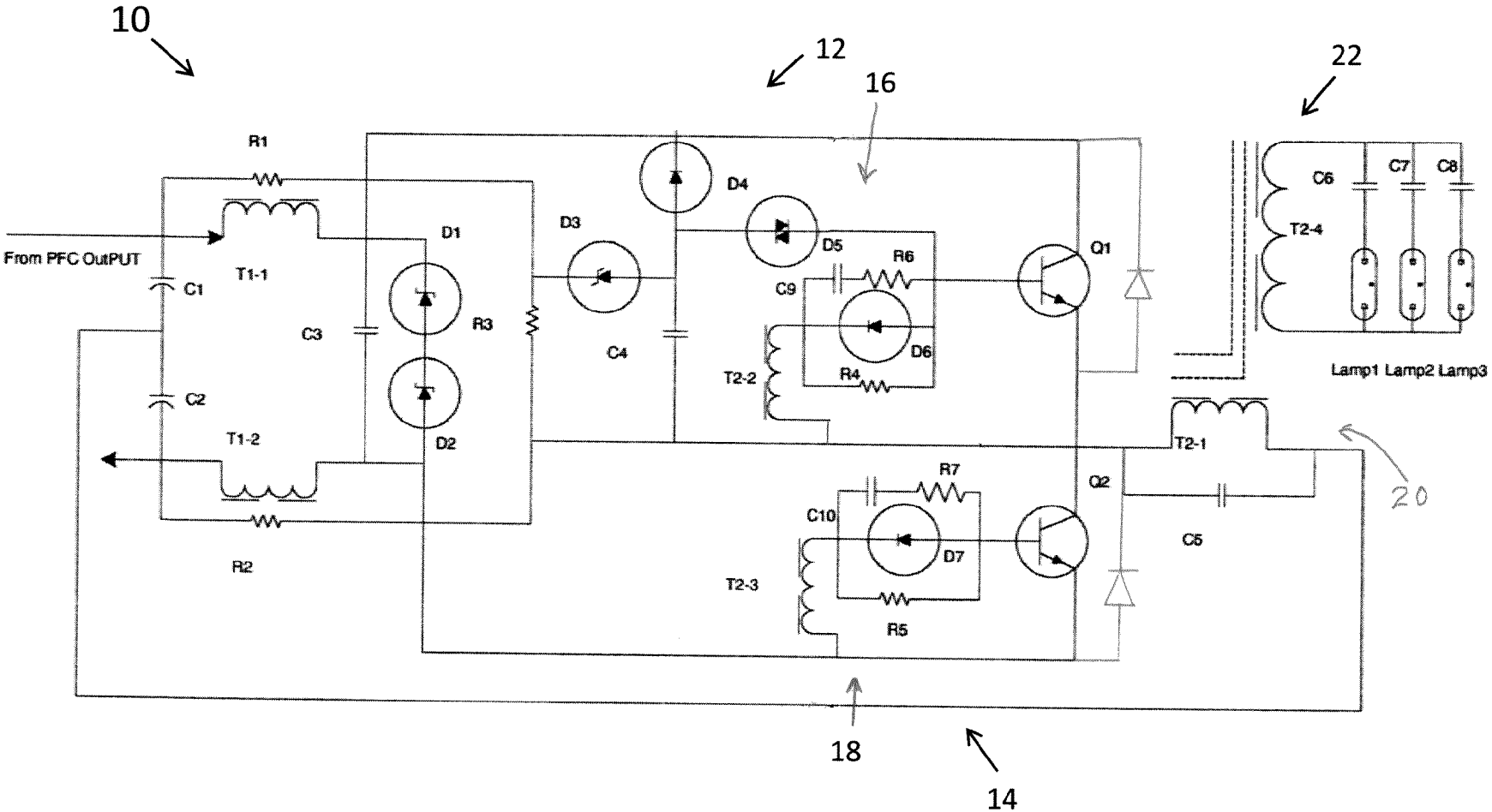
FIG. 2 illustrates the circuit of FIG. 1, implementing the concepts of the present application.

Turning more particularly to ballast circuit 10 of FIG. 2, the first or upper BJT control or base drive circuit 16 is redesigned to incorporate a resistance by resistor R6 and a capacitance by capacitor C9 in series with each other, and the base of BJT switch Q1, as its high-speed drive peak current limiting circuit. Further, second or lower BJT control or base drive circuit 18 is redesigned to include a resistor R7 and a capacitor C10 in series with each other and the base of BJT switch Q2, as its high-speed drive peak current limiting circuit.

Incorporation of capacitors C9 and C10 makes it possible to reduce the value of the resistance provided by resistor R4 of the first control circuit 16, and the value of the resistance provided by resistor R5 of second control circuit 18. By inclusion of capacitors C9 and C10, and thereby a reduction of the values of resistors R4 and R5, the on/off time of the BJT switches Q1 and Q2 are increased, thereby achieving higher inverter efficiency by approximately 1 to 3 percent of inverter operation.

An issue, however, which arises due to adding the caps C9 and C10 is the potential of a higher peak of the base to emitter current at turn-on of the BJTs Q1 and Q2. Such a higher peak current can result in a failure of BJTs Q1, Q2. Therefore, to protect against this undesirable result, ballast circuit 10 is further designed with resistor R6 in first control circuit 16 and resistor R7 in second control circuit 18. These resistors, placed in series with capacitors C9 and C10, respectively, operate to reduce the peak current of the respective control circuits 16 and 18, thereby protecting BJTs Q1, Q2 from receiving destructively high peak currents at Q1 and/or Q2 turn-on/off. At the same time, inclusion of resistors R6 and R7 improves the inverter efficiency and lowers the current crest factor for the lamp.

In one embodiment of circuit 10 of FIG. 2, the values of capacitors C9, C10 and resistors R6, R7 are chosen to be equivalent to each other resulting in a balanced circuit operation. However, in an alternative embodiment, by intentionally selecting the values of capacitors C9 and 010 to be different from each other and/or resistors R6 and R7 to be different from each other, an imbalance in the waveform generated by circuit 10 will occur. This intentional imbalance may be useful in generating high, even harmonic supply voltages for the lamp or lamps. Such high, even harmonic supply voltages are useful in diminishing or eliminating visible striations in lamps. Particularly, it is known to be desirable to create a high even harmonic content with respect to the fundamental waveform of the signal supplied to lamps to increase the striations' frequency above the range in which a human eye is able to detect striation effects. Typically, this frequency is greater than approximately 40 Hz.

Figure 3:
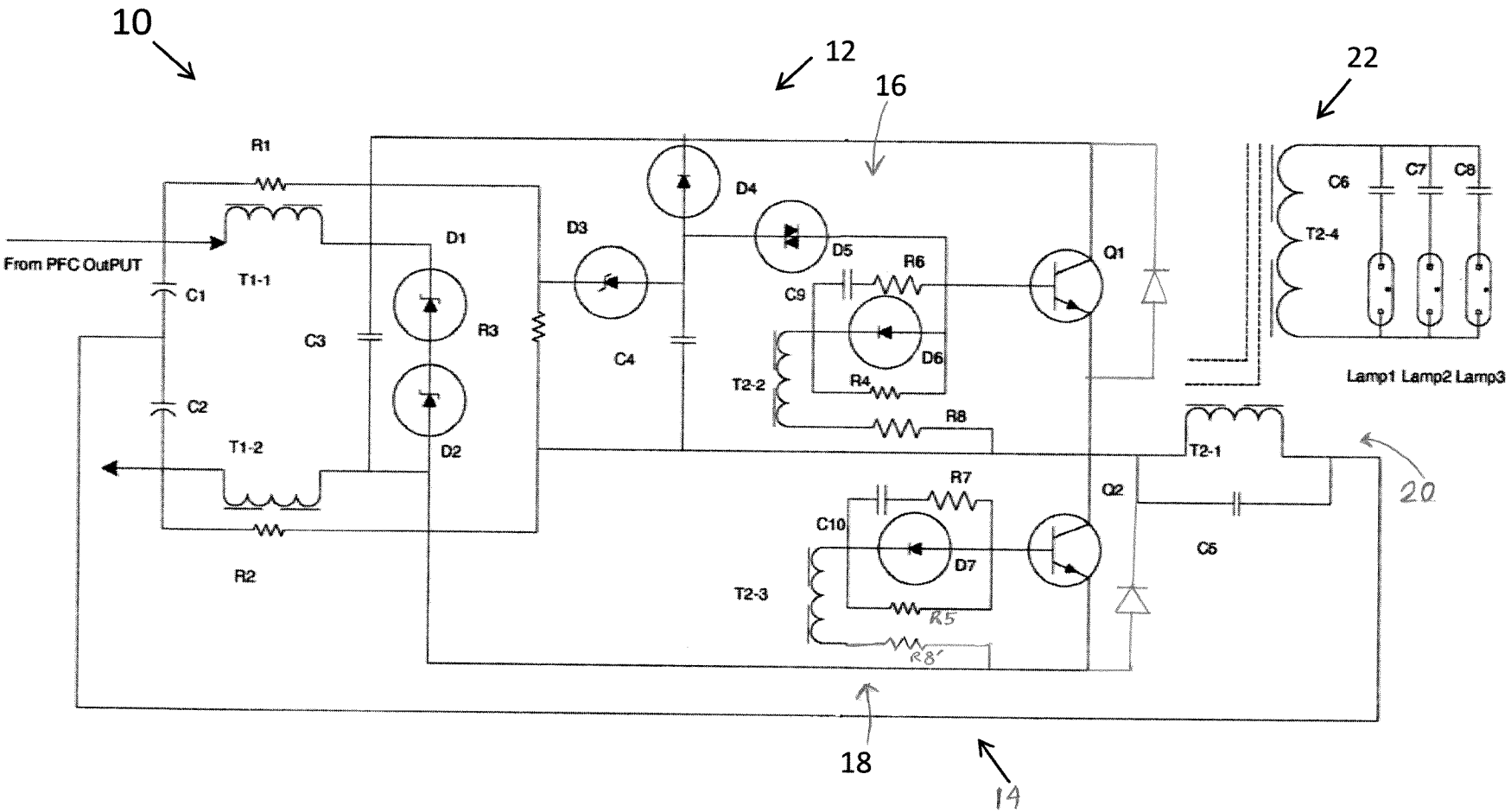
FIG. 3 depicts a further embodiment of concepts related to the present application.

Turning to FIG. 3, ballast circuit 10 depicts yet a further embodiment of the present application. Particularly, in addition to incorporation of capacitors C9, C10 and resistors R6, R7, a separate imbalancing resistor R8 may be added between winding T2-2 and the output line leading to output winding T2-1, placing resistor R8 in series with base drive winding T2-2. Addition of imbalancing resistor R8 provides an imbalance in the output of ballast circuit 10, allowing for an improvement in the even harmonic voltage supplied to the lamps. Such an even harmonic voltage will, again, act to minimize or eliminate visible striations in the lamp or lamps.

It is to be appreciated in FIG. 3, resistor R8' may alternatively be inserted in series with base drive winding T2-3 of the second or lower control circuit 18 and the emitter of BJT switch Q2 (as shown in dotted line) to obtain the higher, even harmonic supply voltage for the lamps. Still further, if R8 and R8' are used at the same time, R6 and R7 could be eliminated.

Addition of capacitors C9 and C10, causes the current needed during turn-on and turn-off of the BJT switches to be provided when the sinusoidal drive winding (e.g., from drive windings T2-2, T2-3) voltages are low, i.e., at crossover. Further, in addition to reducing the dead time when both BJTs are in an "on" state, this design also reduces switching losses. Such an arrangement reduces the circulating current, and therefore as a result the efficiency of the inverter increases. Because the peak of the lamp's current is directly related to the dead time, the smaller the overlap of the BJTs, the lower the crest factor. Increasing the ballast efficiency and, therefore, the lighting system efficiency.

While the values of specific components of the present newly described circuit will depend in part on particular implementations, including operating frequency of the ballast, in at least one embodiment, resistors R4 and R5 may be in the range of 30-100 ohms and particularly 40 ohms. Resistors R6 and R7 may be in the range of 1-10 ohms, particularly 5 ohms, and capacitors C9, C10 may be in the range of 47 nanofarads to 0.22 microfarads. Imbalancing resistor R8 may be in the range of 1-5 ohms.

As previously discussed, FIGS. 1 and 2 illustrates the present concepts are suitable for current fed BJT inverter ballasts, including half-bridge ballast inverters. However, this is not intended to limit the present concepts to the circuit of FIGS. 1 and 2, but rather the concepts may be used in other BJT based circuits such as other current fed half-bridge and full-bridge ballast circuits, including push-pull current fed ballast inverters, as well as voltage fed series resonant ballasts. The design is also useful with high content Krypton mixture, or other appropriate gas mixture, lamps used in non-dimming or dimming applications.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A current fed bipolar junction transistor (BJT) based inverter ballast comprising:

a first base drive circuit configured to drive a first BJT switch;

a second base drive circuit configured to drive a second BJT switch;

a first high-speed drive peak current limiting circuit, configured to operate in conjunction with the first base drive circuit;

a second high-speed drive peak current limiting circuit, configured to operate in conjunction with the second base drive circuit;

wherein the first base drive circuit configured to drive the first BJT switch includes, a first diode-resistor parallel circuit arranged to receive a drive signal and to selectively supply the received drive signal to the first BJT switch; and wherein the first high-speed drive peak current limiting circuit, configured to operate in conjunction with the first base drive circuit includes a first capacitor-resistor series circuit arranged in parallel with the first diode-resistor parallel circuit.

2. The ballast according to claim 1 wherein the second base drive circuit configured to drive the second BJT switch includes, a second diode-resistor parallel circuit arranged to receive a drive signal and to selectively supply the received drive signal to the second BJT switch.

3. The ballast according to claim 2 wherein the second high-speed drive peak current limiting circuit, configured to operate in conjunction with the second base drive circuit includes, a second capacitor-resistor series circuit arranged in parallel with the second diode-resistor parallel circuit.

4. The ballast according to claim 3 wherein values of the resistors and capacitors in the first capacitor-resistor series circuit and the second capacitor-resistor series circuit are equal to each other.

5. The ballast according to claim 3 wherein values of at least one of the resistors and capacitors in the first capacitor-resistor series circuit and the second capacitor-resistor series circuit are un-equal to each other.

6. The ballast according to claim 1 further including an imbalancing resistor connected in series with a drive winding of the first base drive circuit and an emitter of the first BJT switch, wherein the imbalancing resistor, the drive winding of the first base drive circuit, and the emitter of the first BJT switch are all connected in series.

7. The ballast according to claim 1 further including an imbalancing resistor connected in series with a drive winding of the second base drive circuit and an emitter of the second BJT switch, wherein the imbalancing resistor, the drive winding of the second base drive circuit, and the emitter of the first BJT switch are all connected in series.

8. The ballast according to claim 1 wherein the diode is a non-Zener diode.

9. A method of improving efficiency and crest factor of a bipolar junction transistor (BJT) based inverter ballast comprising:

selecting a resistor value of a resistor of a first base drive circuit including a first parallel diode-resistor circuit arranged to receive a drive signal and to selectively supply the received drive signal to a first BJT switch, to obtain a desired first BJT turn-on speed;

selecting a resistor value of a resistor of a second base drive circuit including a second parallel diode-resistor circuit arranged to receive a drive signal and to selectively supply the received drive signal to a second BJT switch, to obtain a desired second BJT turn-on speed;

providing a first high-speed drive peak current limit circuit to operate in conjunction with the first base drive circuit;

providing a second high-speed drive peak current limit circuit to operate in conjunction with the second base drive circuit; and wherein the providing of the first and second high-speed drive peak current limit circuits lowers power dissipation on the first and second BJT switches.

10. The method according to claim 9 wherein the providing of the first and second high-speed drive peak current limit circuits increases the turn-off time of the first and second BJT switches.

11. The method according to claim 9 further including an imbalancing resistance connected in series with a drive winding of the first base drive circuit and an emitter of the first BJT switch.

12. The method according to claim 9 further including an imbalancing resistance connected in series with a drive winding of the second base drive circuit and an emitter of the second BJT switch.

13. A method of improving efficiency and crest factor of a bipolar junction transistor (BJT) based inverter ballast comprising:

selecting a resistor value of a resistor of a first base drive circuit including a first parallel diode-resistor circuit arranged to receive a drive signal and to selectively supply the received drive signal to a first BJT switch, to obtain a desired first BJT turn-on speed;

selecting a resistor value of a resistor of a second base drive circuit including a second parallel diode-resistor circuit arranged to receive a drive signal and to selectively supply the received drive signal to a second BJT switch, to obtain a desired second BJT turn-on speed;

providing a first high-speed drive peak current limit circuit to operate in conjunction with the first base drive circuit;

providing a second high-speed drive peak current limit circuit to operate in conjunction with the second base drive circuit; and wherein the providing the first and second high-speed drive peak current limit circuits generate even harmonic voltage waveforms, which are supplied to lamps controlled by the ballast.

14. The method according to claim 13 wherein at least one of resistor and capacitor values of the first high-speed drive peak current limit circuit, and at least one of resistor and capacitor values of the second high-speed drive reverse peak current limit circuit are different from each other, wherein even harmonic voltage waveforms are generated and supplied to lamps controlled by the ballast.

* * * * *